US005834725A

United States Patent [19]

Clarke et al.

[11] Patent Number: 5,834,725

[45] Date of Patent: Nov. 10, 1998

[54] CIRCUIT INTERRUPTER ARRANGEMENT

[75] Inventors: Roy Clarke, Unsworth; Carl Christopher Ennis, Middleton; John Stanley Stewart, Wilmslow, all of United Kingdom

[73] Assignee: GEC Alsthom Limited, United Kingdom

[21] Appl. No.: 635,463

[22] Filed: Apr. 22, 1996

[30] Foreign Application Priority Data

Apr. 27, 1995 [GB] United Kingdom ..... 9508532

[51] Int. Cl.[6] ..... H01H 33/66

[52] U.S. Cl. ..... 218/120; 218/154; 218/12

[58] Field of Search ..... 218/1–10, 12, 218/14, 44, 45, 55, 67, 79, 80, 84, 118, 119, 120, 140, 141, 142, 150, 153, 154

[56] References Cited

U.S. PATENT DOCUMENTS

| | | | |
|---|---|---|---|
| 3,769,478 | 10/1973 | Weston et al. | 200/146 R |
| 4,458,119 | 7/1984 | Hashimoto et al. | 200/145 |
| 4,484,044 | 11/1984 | Yoshigae | 200/144 B |
| 4,484,046 | 11/1984 | Neuhouser | 200/144 B |
| 4,727,229 | 2/1988 | Hodkin | 200/144 B |
| 4,814,559 | 3/1989 | Stegmuller | 200/145 |

FOREIGN PATENT DOCUMENTS

| | | | |
|---|---|---|---|
| 1028719 | 5/1966 | United Kingdom | H01H 33/66 |
| 2 129 617 | 5/1984 | United Kingdom | H01H 33/52 |
| 2 170 354 | 7/1986 | United Kingdom | H01H 33/52 |
| 2 217 916 | 11/1989 | United Kingdom | H01H 33/66 |

*Primary Examiner*—Michael A. Friedhofer
*Attorney, Agent, or Firm*—Kirschstein, et al.

[57] ABSTRACT

A vacuum recloser in which an isolator switch is incorporated in series with the vacuum interrupter and is driven by the same actuator. The isolator must only be operated when the vacuum switch is open and no arc current remains. This is ensured in one of two ways (a) by providing a significant lost motion in the isolator drive, giving, say, 20 milliseconds between opening of the vacuum contacts and opening of the isolator contacts, and (b) by latching the isolator drive against opening, compressing a spring against the latch by the actuator attempting to open the isolator, and tripping the latch by a solenoid responsive to lock-out conditions.

7 Claims, 2 Drawing Sheets

CIRCUIT INTERRUPTER ARRANGEMENT

BACKGROUND OF THE INVENTION

This invention relates to circuit interrupter arrangements and particularly to such arrangements employing vacuum interrupters in auto-reclosers.

The use of vacuum as the interrupting medium offers many benefits in the case of auto-reclosing duties in overhead line applications. Such advantages include the capability of these devices to perform a large number of operations without the need for maintenance, low operational energy requirements allowing power to be supplied by batteries, and the elimination of environmentally unfriendly interruption by-products.

However in common with all switching devices, when the contacts are in the open position, the downstream terminal can attain some potential due to 'capacitive coupling' across the vacuum gap. A disadvantage of the vacuum interrupter is that the contact gap required for interruption may be insufficient to meet the 'impulse-voltage-withstand' requirement for isolation purposes.

It is for this reason that users will insist that when the system is required to be electrically isolated, separately mounted air break switch disconnectors, i.e. "isolators", must be installed in series with the recloser. The main disadvantage with this is that this additional equipment is costly to purchase/install is maintenance intensive, and often must be operated manually.

An object of the present invention is to provide a circuit interrupter arrangement for use as an automatic 'recloser' which overcomes or at least alleviates the problems outlined above arising particularly from the use of vacuum switches.

SUMMARY OF THE INVENTION

According to the present invention, a circuit interrupter arrangement comprises a vacuum interrupter, an isolator and a coupling means, said interrupter and said isolator being connected electrically in series and being driven by a common electromagnetic actuator, said coupling means coupling the isolator and the actuator in such a manner that the isolator can open and can close only when the vacuum interrupter is already open.

The vacuum interrupter may be mounted on one line terminal of the arrangement and the isolator mounted on a second line terminal, the isolator including a pivoted contact blade adapted to make and break contact with a terminal connection of the vacuum interrupter.

The coupling means preferably includes an isolator driving mechanism, and a vacuum interrupter driving mechanism, the actuator being mounted between the isolator and vacuum interrupter driving mechanisms so as to push one and pull the other at each actuation.

The interrupter arrangement may be for use in a polyphase supply system and include a vacuum interrupter and series connected isolator in respect of each phase and an actuator common to all phases.

The interrupter arrangement is preferably contained in a single housing.

The coupling means may include a lost motion coupling between the actuator and the isolator to provide a delay between opening of the vacuum switch and opening of the isolator—this delay being sufficient to cover the arc clearance time for the vacuum interrupter plus at least a 50% safety margin. This delay is desirably approximately 20 milliseconds.

In a modification of the above embodiment, the coupling means coupling the isolator to the actuator may include a latching mechanism which in a latched condition prevents the actuator from opening the isolator, spring means which, in the open condition of the actuator and subject to the latching mechanism drives the isolator into the open condition, and latch tripping means responsive to predetermined switch conditions to trip the latching mechanism and allow the isolator to open. There is preferably provided control means for tripping the latching mechanism when the actuator is locked in the open condition and current through the vacuum interrupter is zero.

The control means preferably includes a solenoid for tripping the latching mechanism.

BRIEF DESCRIPTION OF THE DRAWINGS

A circuit interrupter employing a vacuum interrupter will now be described, by way of example, with reference to the accompanying drawings, of which.

DESCRIPTION OF PREFERRED EMBODIMENTS OF THE INVENTION

Auto-reclosers are circuit interrupters which, having broken the circuit in the event of a fault, indicated by an increase in line current beyond preset limits, then, under programmed control make several attempts to re-close so that if the fault was transient the circuit will quickly revert to normal with minimum interruption of supply and no manual intervention. Auto-reclosers are clearly of great value in remote situations where manual maintenance may be difficult and time consuming. Where the fault is more serious the attempts at re-closing fail and the recloser reaches the end of its preset programme. After perhaps three attempts at re-closing without success, the interrupter then automatically is locked in the open position , until the fault is remedied independently.

One example of an auto-re-closer is described in our UK Patent Application Serial No. 2269063.

As mentioned above, vacuum switches are particularly attractive for use in auto-reclosers for the reasons given. However, the small contact gap and consequent high capacitance of vacuum switches causes a problem when they are used to isolate a section of a line supply system in order that repair work might be undertaken on that section. Voltage levels as high as 170 KV may appear on the line 'upstream' of the interrupter and the contact gap may break down under this stress.

It is common therefore to require an isolator to be installed in series with the vacuum switch this isolator normally being manually operated or at least manually tripped, to provide the necessary protection to the downstream fault section.

The present invention provides a new approach to the provision of an isolator.

Figure 1:
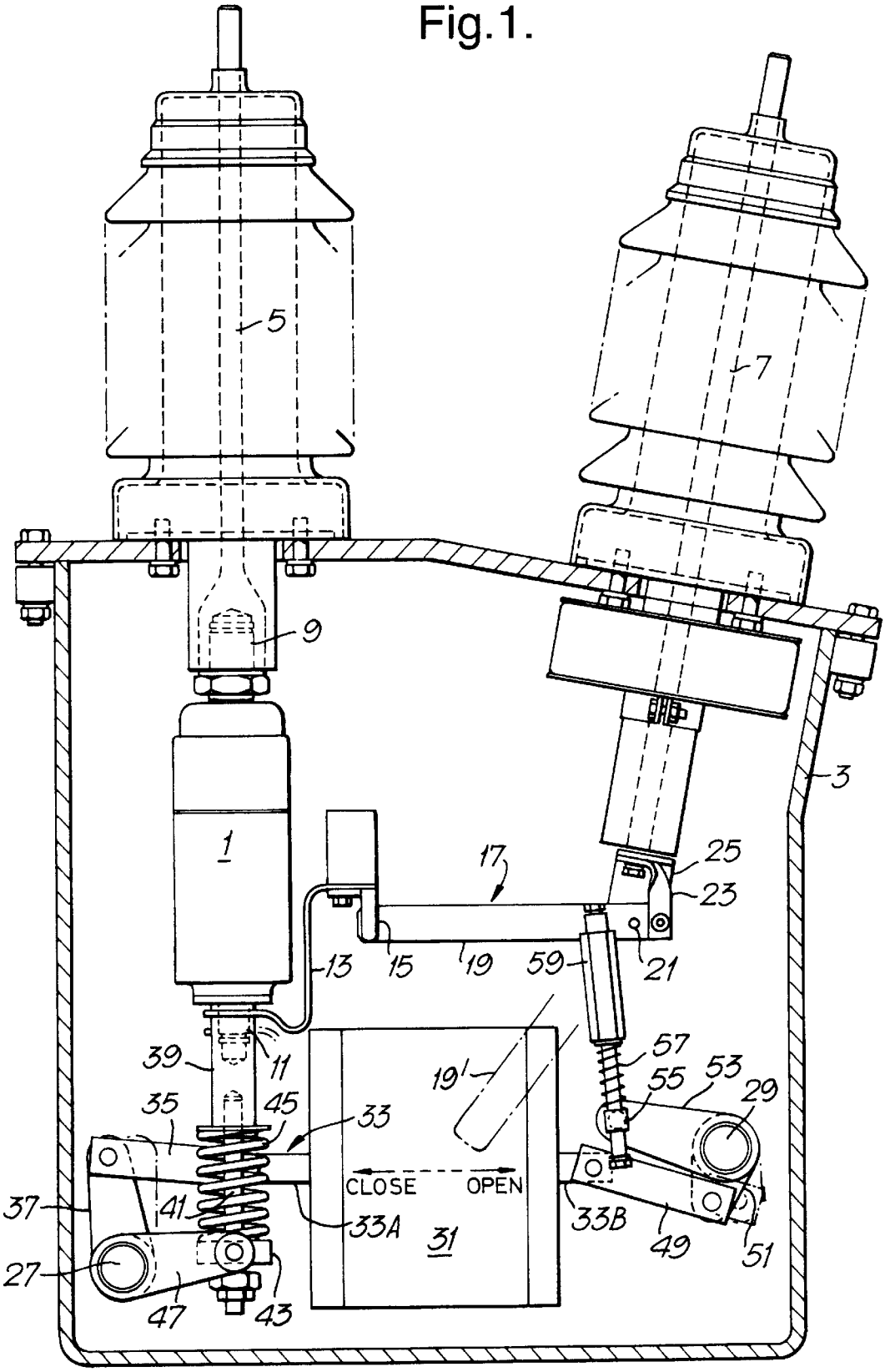
FIG. 1 is an end view of an interrupter arrangement in a sectioned enclosure showing the main components.

Referring to FIG. 1 of the drawings, a vacuum interrupter 1 is enclosed in an insulating housing 3 and is mounted on an extension of one line terminal 5. Both terminal and terminal 7 are insulated in shedded bushings in known manner and mounted on the 'lid' of the housing.

The vacuum interrupter 1 has an upper, fixed terminal 9 and a lower movable terminal 11 connected to their respective vacuum enclosed contacts (not shown). The movable terminal 11 is connected by a flexible electrical link 13 to a fixed contact 15 of an isolator switch 17. The contact 15 is of sprung forked form and embraces a contact blade 19 of the isolator. The contact blade 19 is pivoted at the remote end (21) and is shown in broken lines 19 in the isolator-open position. The pivoted end of the blade 19 is then connected by straps 23 and 25 to the inner end of the terminal 7.

The vacuum interrupter and isolator are thus connected in series between the two line terminals 5 and 7.

While the drawing shows only one combination of vacuum interrupter and isolator there are in fact three such pairs, one for each phase of a three-phase system. The view taken in FIG. 1 shows the three identical combinations superimposed and thus not apparent. The invention is not limited to any particular number of phases.

The three switch/isolator sets are driven in synchronism, there being two drive shafts 27 and 29 extending (27) past the vacuum interrupters and (29) past the isolators. Both shafts are driven by a common actuator 31, which may be of a type described in detail in the above UK Patent Spec No. 2269063. Very briefly this consists of a shaft on which is mounted a cylindrical iron armature. The shaft and armature move axially between two stable positions determined by a common permanent magnet and alternative ferromagnetic circuits each having a solenoid. Energisation of the solenoids selectively determines the position of the shaft, 'open' or 'closed'. In FIG. 1 the actuator shaft is horizontal and drives to the left to close the interrupter and to the right to open it. As can be seen, the shaft 33 protrudes from both ends of the actuator to rotate the shafts 27 and 29. The shaft end 33A is coupled to a link 35 which in turn is coupled to a crank arm 37 fixed to the shaft 27. Thus movement of the actuator shaft 33 to the left rotates the shaft 27 anti-clockwise.

The actuator 31 is positioned between the planes of two of the vacuum interrupters 1 so as not to interfere with the immediate driving mechanisms of the vacuum interrupters.

Each vacuum interrupter 1 has a movable terminal 11 which is coupled to the driving shaft 27 by an insulating rod 39 into which is screwed a metal rod 41. Mounted on the rod 41 is a lost motion device consisting of a collar 43 which slides on the rod 41 against a spring 45. The collar 43 is driven by a crank arm 47 fixedly mounted on the shaft 27.

When the actuator 'close' coil is energised the actuator shaft moves to its limit position driving the collar 43, spring 45 and rod 39 upwards. When the vacuum contacts engage, further movement of the arm 47 and collar 43 is taken up by compression of the spring 45.

The isolator switch 17 is coupled to the other end 33B of the actuator shaft. This end 33B is coupled to the shaft 29 by way of a link 49 and crank arm 51. At three positions on the shaft 29 respective crank arms such as that 53 are mounted. The crank arm 53 is coupled to a collar 55 which drives the isolator blade 19 through a lost motion spring 57 and insulating rod 59.

In an opening operation of the interrupter the vacuum interrupter is required to open before the isolator and the delay between the two must be such as to allow any breaking arc in the vacuum interrupter to clear. This arc clearing process typically takes up to 9 milliseconds to complete fully, i.e. to establish a current zero. However, to accommodate unexpected fault conditions a minimum 50% margin is provided and preferably a margin in the region of 100% Thus, in the present case a delay of 20 milliseconds is provided by the lost motion device in the isolator drive. As the actuator shaft 33 moves to the right, first the spring 45 in the vacuum interrupter drive expands and then the vacuum contacts open. Meanwhile the spring 57 in the isolator drive is still expanding and continues to do so until the 20 milliseconds delay mentioned above is achieved. The blade 19 is then pulled down, to disengage the fixed contact 15 and so isolate the system downstream. It is apparent therefore that, while the lost motion in the vacuum interrupter drive need only be sufficient to accommodate tolerances in manufacture and assembly, the lost motion in the isolator drive must be considerably more than this to achieve the necessary arc-clearing delay.

In the closing operation the above relation between the lost motions in the vacuum interrupter drive and isolator drive produces the effect that the isolator closes before the vacuum interrupter. It is not so important in this case that there be a significant delay between the two closures since the current should be at zero, when the isolator closes.

It will be apparent that, because of the large physical gap required of the isolator the velocity of the isolator blade is considerable at the point of closure. It is desirable therefore to avoid any unnecessary closures because of the damage that may ensue from repeated high speed operation, although the components are of course made sufficiently robust to withstand such wear and tear for a considerable number of operations.

It is a feature of auto-reclosers that in the event of a fault and consequent operation of the interrupter, the relay unit controlling the operation of the actuator can be programmed to make a number of attempts to re-close in the hope that the fault was transient and had self cleared. There may be perhaps three such attempts before the relay unit concludes that the fault is not transient and 'locks out' the interrupter with the vacuum interrupter and isolator open.

Figure 2:
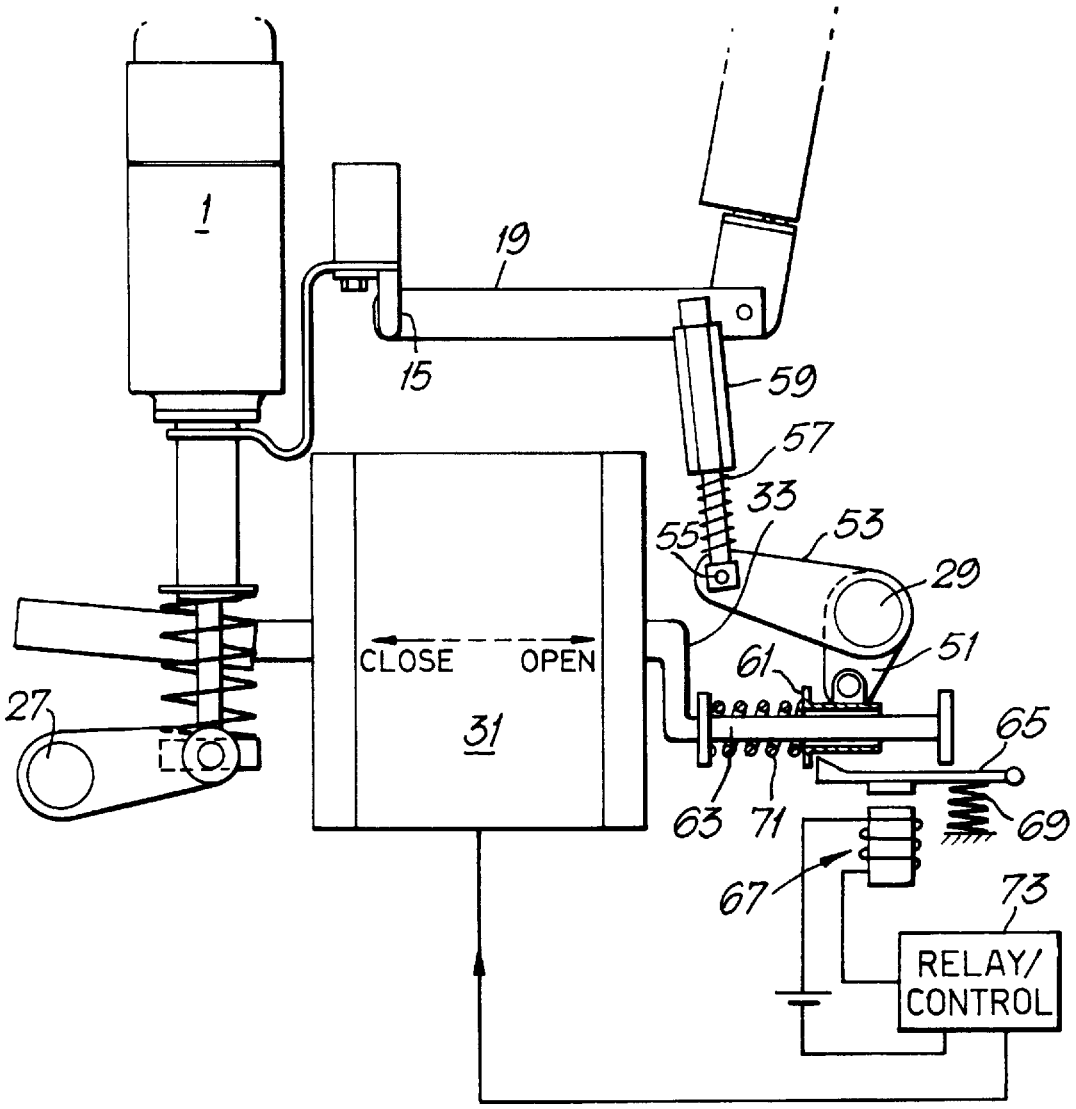
FIG. 2 is a diagrammatic view of a modification of part of the structure of FIG. 1.

Unfortunately, as mentioned above, such repeated operations, with perhaps only a quarter second between each, tend to increase wear of the equipment unduly. A modification of the interrupter arrangement in accordance with the accompanying FIG. 2 is designed to overcome this disadvantage.

In this modified arrangement the vacuum interrupter driving mechanism is coupled to the actuator as in FIG. 1. The isolator switch 17 is as before but is driven differently.

A driving arm comprising insulating rod 59 spring 57, collar 55 etc. is coupled to the isolator blade at one end and to its own crank arm 53 on the shaft 29 as before. The crank arm 51 is now however coupled to a sliding collar 61 on an extension 63 of the actuator shaft 33. An electromechanical latch including a pivoted arm 65 and a solenoid 67 limit movement of the collar 61 to the right so preventing opening of the isolator. The latch arm 65 is biased upwards to engage the collar 61 by a spring 69.

When the actuator attempts to open the interrupter the shaft 33 moves to the right so opening the vacuum switch contacts. It also compresses a spring 71 against the collar 61 but without moving the collar or, therefore, the isolator. The solenoid 67, controlled by a control unit 73 is not energised at this time and the latch engages the collar 61.

The use of the latch in this way puts the isolator under the control of the relay (i.e. the control circuitry which detects line current, energises the actuator and monitors the interrupter operation) instead of tying the isolator operation to that of the vacuum interrupter albeit with inbuilt delay. The relay is programmed to make (say) three attempts at energising the actuator to close the vacuum interrupter with intervening delays sufficient to allow arc clearance. In this latching embodiment the relay is also programmed to make no attempt to energise the solenoid 67 until all attempts have been made. Even then further conditions are imposed before the isolator can be opened. The relay must determine that the actuator is in the open condition, so ensuring that the spring 71 is 'charged up', i.e. compressed, and also the relay must sense that no current is flowing through the interrupter.

The latching modification therefore requires no preset lost motion delay to achieve an arc-clearance condition and also is not opened unnecessarily at each failed re-close attempt.

In a closing operation the actuator shaft 63 drives the collar 61 to the left so rotating shaft 29 clockwise and closing the isolator contacts. A sufficient degree of lost motion in the vacuum interrupter drive ensures that the vacuum interrupter contacts close last.

What is claimed is:

1. A circuit interrupter arrangement, comprising: a vacuum interrupter; an isolator; and an electromagnetic actuator, said interrupter and said isolator being connected electrically in series and being both driven by said actuator such that the isolator can open and close only when the interrupter is already open, said actuator driving said isolator by way of a latching arrangement, said latching arrangement including a latching means, a spring means, a latch-tripping means, and a trip-signal receiving means connected to said latch-tripping means, said latching means in a latched condition preventing the actuator from opening the isolator, said spring means being charged during an open condition of said interrupter and being allowed, upon receipt of a trip signal by said trip-signal receiving means, to drive said isolator into an open condition by operation of said latch-tripping means.

2. The interrupter arrangement according to claim 1, and further comprising a control means for supplying the trip signal to said trip-signal receiving means only when predetermined switching conditions prevail.

3. The interrupter arrangement according to claim 2, wherein said control means supplies the trip signal only when said actuator is locked in an open condition and when current through said interrupter is zero.

4. The interrupter arrangement according to claim 1, and further comprising first and second line terminals, and wherein said interrupter includes first and second interrupter terminals, said interrupter being mounted on said first line terminal by way of said first interrupter terminal, and said isolator being mounted on said second line terminal, said isolator including a pivoted contact blade which, in use, makes and breaks electrical contact with said second interrupter terminal.

5. The interrupter arrangement according to claim 1, and further comprising an isolator driving mechanism connected to said latching arrangement and an interrupter driving mechanism, said actuator being mounted between said isolator and said interrupter driving mechanisms so as, in use, to push one and pull the other.

6. The interrupter arrangement according to claim 1, and further comprising a single housing for containing the interrupter arrangement.

7. The interrupter arrangement according to claim 1, wherein said latching arrangement includes a lost motion coupling between said actuator and said isolator to provide a delay between opening of said vacuum interrupter and opening of said isolator.

* * * * *